US011654944B2

(12) United States Patent
Ito et al.

(10) Patent No.: US 11,654,944 B2
(45) Date of Patent: May 23, 2023

(54) OPERATION STATUS REPRODUCING DEVICE, DISPLAY DEVICE, AND OPERATION STATUS REPRODUCING METHOD

(71) Applicant: Mitsubishi Electric Corporation, Tokyo (JP)

(72) Inventors: Takahiro Ito, Tokyo (JP); Hiromi Goda, Tokyo (JP); Masayo Nakagawa, Tokyo (JP); Hiroe Takenaga, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1037 days.

(21) Appl. No.: 16/335,288

(22) PCT Filed: Oct. 5, 2016

(86) PCT No.: PCT/JP2016/079682

§ 371 (c)(1),
(2) Date: Mar. 21, 2019

(87) PCT Pub. No.: WO2018/066096

PCT Pub. Date: Apr. 12, 2018

(65) Prior Publication Data

US 2019/0217875 A1 Jul. 18, 2019

(51) Int. Cl.
*B61L 15/00* (2006.01)
*B61L 13/00* (2006.01)
(Continued)

(52) U.S. Cl.
CPC ..... *B61L 15/009* (2013.01); *B61L 13/005* (2013.01); *B61L 15/0072* (2013.01); *B61L 25/04* (2013.01);
(Continued)

(58) Field of Classification Search
CPC ..... B61L 15/009; B61L 27/20; B61L 27/40; B61L 13/005; B61L 15/0072; B61L 25/04; B61L 27/00
See application file for complete search history.

(56) References Cited

U.S. PATENT DOCUMENTS 8,732,743 B2 * 5/2014 Morimoto ..... H04H 60/72 725/75
2007/0124332 A1 * 5/2007 Ballesty ..... B61L 27/57
(Continued)

FOREIGN PATENT DOCUMENTS

JP H04252769 A 9/1992
JP 2003118577 A 4/2003
(Continued)

OTHER PUBLICATIONS

Extended European Search Report dated Dec. 13, 2019 for corresponding European patent application No. 16918293.8, 10 pages.
(Continued)

*Primary Examiner* — Peter D Nolan
*Assistant Examiner* — Demetra R Smith-Stewart
(74) *Attorney, Agent, or Firm* — Buchanan Ingersoll & Rooney PC

(57) ABSTRACT

An operation status reproducing device includes an onboard information obtaining unit that obtains onboard information corresponding to date and time from an onboard device mounted on a designated train being a train specified by a train number and the date and time externally designated, a specific event detecting unit that specifies time at which a specific event occurs by analyzing the onboard information, a ground information obtaining unit that obtains ground information in a certain period including the time at which the specific event occurs from a ground device, an external information obtaining unit that obtains external information including weather information in a certain period including
(Continued)

the time at which the specific event occurs, and a reproduction image generating unit that generates a reproduction image illustrating a past operation status of the designated train based on the onboard information, the ground information, and the external information.

10 Claims, 11 Drawing Sheets

(51) Int. Cl.

| | |
|---|---|
| ***B61L 25/04*** | (2006.01) |
| ***B61L 27/00*** | (2022.01) |
| ***B61L 27/20*** | (2022.01) |
| ***B61L 27/40*** | (2022.01) |

(52) U.S. Cl.
CPC ..... *B61L 27/00* (2013.01); *B61L 27/20* (2022.01); *B61L 27/40* (2022.01)

(56) References Cited

U.S. PATENT DOCUMENTS

| | | | | |
|---|---|---|---|---|
| 2007/0216771 | A1* | 9/2007 | Kumar | B61L 27/53 348/148 |
| 2011/0216200 | A1 | 9/2011 | Chung et al. | |
| 2013/0046421 | A1* | 2/2013 | El Fassi | B61L 27/04 701/2 |
| 2014/0222971 | A1 | 8/2014 | Cooper et al. | |
| 2016/0159381 | A1 | 6/2016 | Fahmy | |
| 2016/0200331 | A1* | 7/2016 | Palmer | B61L 15/0072 246/123 |

FOREIGN PATENT DOCUMENTS

| | | |
|---|---|---|
| JP | 2008217609 A | 9/2008 |
| JP | 2009183109 A | 8/2009 |
| JP | 2013047055 A | 3/2013 |

OTHER PUBLICATIONS

Office Action dated Feb. 25, 2021 in corresponding Indian Patent Application No. 201947009883, 5 pages.
Office Action (Notice of Reasons for Refusal) dated Jun. 18, 2019, by the Japan Patent Office in corresponding Japanese Patent Application No. 2018-543533 and English translation of the Office Action. (5 pages).
International Search Report (PCT/ISA/210) dated Dec. 27, 2016, by the Japan Patent Office as the International Searching Authority for International Application No. PCT/JP2016/079682.
Written Opinion (PCT/ISA/237) dated Dec. 27, 2016, by the Japan Patent Office as the International Searching Authority for International Application No. PCT/JP2016/079682.
European communication pursuant to Article 94(3) EPC dated Sep. 30, 2021, for European Patent Application No. 16918293.8, 4 pages.
Office Action (Notification of Reasons for Refusal) dated Feb. 26, 2019, by the Japanese Patent Office in corresponding Japanese Patent Application No. 2018-543533 and English translation of the Office Action (7 pages).
European communication pursuant to Article 94(3) EPC dated Nov. 27, 2020 for European Patent Application No. 16918293.8, 9 pages.
Office Action issued in corresponding European Patent Application No. 16918293.8, dated Feb. 28, 2023, 3 pages.

* cited by examiner

| NO. | TRAIN NUMBER | DATE AND TIME | SELECT |
|---|---|---|---|
| 1 | A1001 | APRIL XX, 2016 07:30 TO 08:00 | |
| 2 | A1001 | APRIL XX, 2016 08:00 TO 09:00 | ✔ |
| 3 | B1025 | APRIL YY, 2016 18:20 TO 18:35 | |
| 4 | B1034 | MAY ZZ, 2016 16:30 TO 19:00 | |
| 5 | ... | ... | |

OPERATION STATUS REPRODUCING DEVICE, DISPLAY DEVICE, AND OPERATION STATUS REPRODUCING METHOD

FIELD

The present invention relates to an operation status reproducing device that reproduces an operation status of a train, a display device, and an operation status reproducing method.

BACKGROUND

In a railway system, an operation status of a train is managed by a ground device installed on a ground side and an onboard device mounted on each train. The ground device generally monitors an operation status as an entire railway system and stores a monitored result. The onboard device generally monitors a state of various devices mounted on the train and contents of operation performed by an operator to store a monitored result. The monitored results stored in the ground device and the onboard device are used at the time of follow-up verification when abnormality occurs represented by train delay and car malfunction. This is also studied to be used for training operators.

Patent Literature 1 discloses an invention of recording data such as a picture of an operation status of an operator and the like, audio in an operator's room and announced contents in a train, and an operation result of the operator and binding data separately recorded to reproduce on a display device.

CITATION LIST

Patent Literature

Patent Literature 1: Japanese Patent Application Laid-open No. 2013-47055

SUMMARY

Technical Problem

According to the invention disclosed in Patent Literature 1, it is possible to check the operation status when a specific event occurs by checking a picture displayed on the display device. However, it is required to check the operation status reproduced by binding all data separately recorded. Therefore, there is a problem that handled data is enormous and a capacity of a storage device that records the data becomes large. Also, when verifying the specific event, it is required that a worker check all the recorded pictures to search for an event to be verified, so that work efficiency is not excellent.

The present invention is achieved in view of above and an object thereof is to obtain an operation status reproducing device capable of efficiently performing verification of the operation status.

Solution to Problem

To solve the problem described above and achieve the object described above, the present invention is an operation status reproducing device that reproduces an operation status of a train based on onboard information managed by an onboard device mounted on each train of a railway system and ground information managed by a ground device that monitors an operation status of each train of the railway system. The operation status reproducing device includes: an onboard information obtaining unit that obtains the onboard information corresponding to date and time from the onboard device mounted on a designated train that is a train specified by a train number and the date and time externally designated; a specific event detecting unit that specifies time at which a specific event occurs by analyzing the onboard information obtained by the onboard information obtaining unit; a ground information obtaining unit that obtains the ground information in a certain period including the time at which the specific event occurs from the ground device; an external information obtaining unit that obtains external information including weather information in a certain period including the time at which the specific event occurs; and a reproduction image generating unit that generates a reproduction image illustrating a past operation status of the designated train based on the onboard information, the ground information, and the external information.

Advantageous Effects of Invention

According to the operation status reproducing device according to the present invention, there is an effect of efficiently performing verification of an operation status.

DESCRIPTION OF EMBODIMENTS

An operation status reproducing device, a display device, and an operation status reproducing method according to an embodiment of the present invention are hereinafter described in detail with reference to the drawings. Meanwhile, the present invention is not limited by the embodiment.

First Embodiment

Figure 1:
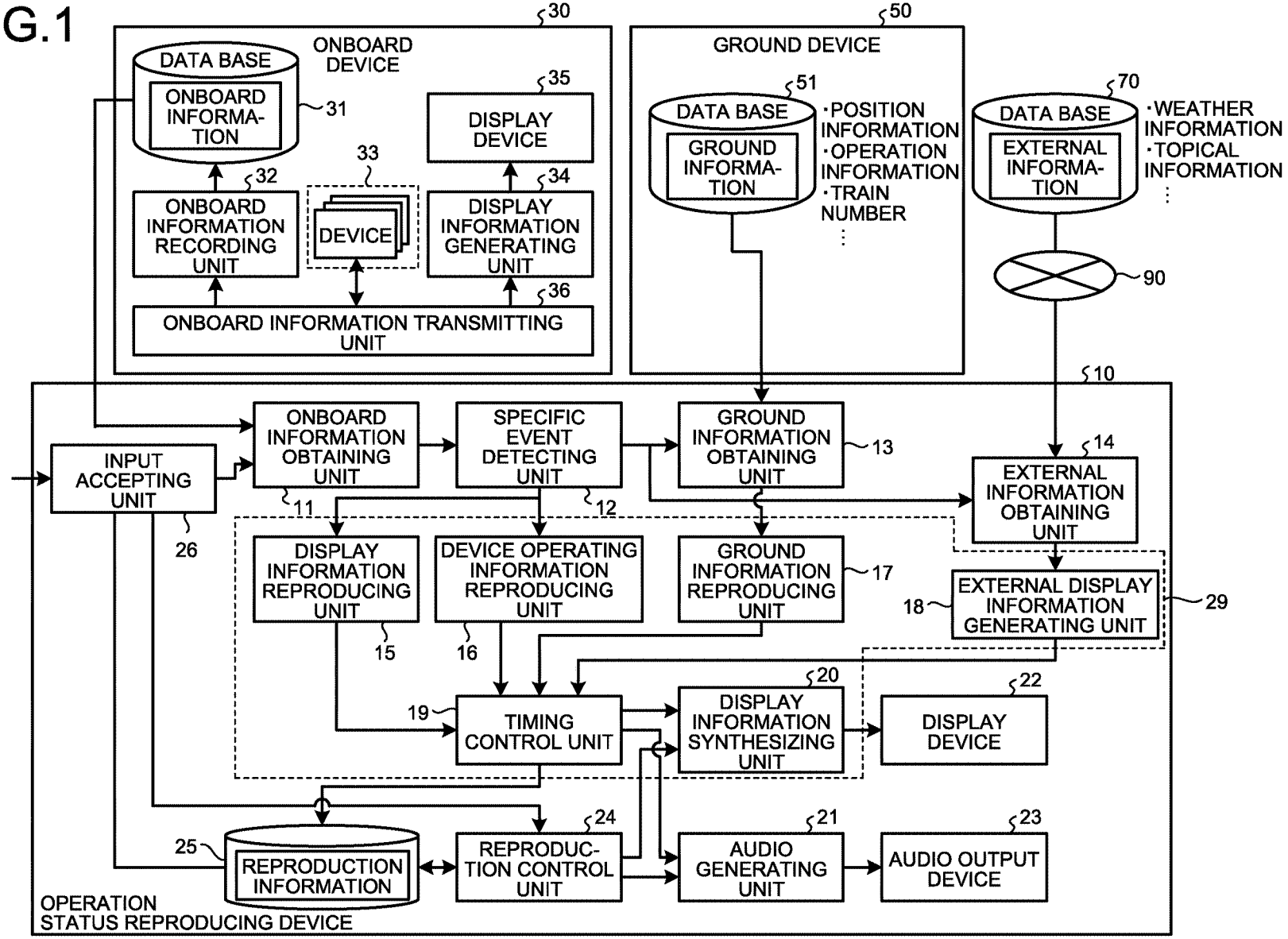
FIG. 1 is a diagram illustrating a configuration example of an operation status reproducing device according to a first embodiment of the present invention.

FIG. 1 is a diagram illustrating a configuration example of an operation status reproducing device according to a first embodiment of the present invention. An operation status reproducing device 10 illustrated in FIG. 1 is a device that reproduces a past operation status of a train. Meanwhile, in FIG. 1, a device from which various pieces of information used when the operation status reproducing device 10 reproduces an operation status of the train are obtained, specifically, an onboard device 30 mounted on the train, a ground device 50 installed on a ground, and a database 70 connected to a network 90 such as the Internet are also illustrated in addition to the operation status reproducing device 10. The onboard device 30 monitors a state of each unit in the train when the train on which the same is mounted is in operation, generates information indicating a monitored result, and manages the same as onboard information. The ground device 50 monitors the operation status of each train forming a railway system, generates information indicating a monitored result of the operation status of each train, and manages the same as ground information.

The operation status reproducing device 10 includes an onboard information obtaining unit 11, a specific event detecting unit 12, a ground information obtaining unit 13, an external information obtaining unit 14, a display information reproducing unit 15, a device operating information reproducing unit 16, a ground information reproducing unit 17, an external display information generating unit 18, a timing control unit 19, a display information synthesizing unit 20, an audio generating unit 21, a display device 22, an audio output device 23, a reproduction control unit 24, a database 25, and an input accepting unit 26. The display information reproducing unit 15, the device operating information reproducing unit 16, the ground information reproducing unit 17, the external display information generating unit 18, the timing control unit 19, and the display information synthesizing unit 20 form a reproduction image generating unit 29 and generates a reproduction image illustrating the past operation status of the train as an image to be displayed on the display device 22.

The onboard information obtaining unit 11 obtains the onboard information from a database 31 of the onboard device 30. The onboard information obtained by the onboard information obtaining unit 11 is information regarding past operation of the train on which the onboard device 30 is mounted and corresponds to operation start time, a travel line, a train type, a travel speed, a stopping station, arrival time, departure time, information on operation performed by an operator, information on an operating state of a device mounted on the train, a picture taken by a video camera installed in an operator's room and the like collected at the time of past operation. The device mounted on the train corresponds to a motor, a brake device, an air-conditioner device, an illumination device, a door opening/closing device, a display device and the like. The onboard information obtained by the onboard information obtaining unit 11 includes time information. The time information included in the onboard information is information on date and time at which the onboard information is recorded by the onboard device 30, that is, information on the date and time at which the onboard information is recorded in the database 31. Meanwhile, the onboard information is not limited to the information. Although one onboard device 30 is illustrated in FIG. 1 for simplifying the description, there actually is a plurality of onboard devices 30. As is to be separately described in detail, the onboard information obtaining unit 11 obtains the onboard information from the onboard device 30 mounted on a train designated by a user through the input accepting unit 26.

The onboard device 30 illustrated in FIG. 1 is herein described. The onboard device 30 includes the database 31 that manages the onboard information, an onboard information recording unit 32 that collects the information recorded in the database 31 as the onboard information from a device group 33 through an onboard information transmitting unit 36, and a display information generating unit 34 that generates display information of an image displayed on a display device 35 and the like. The device group 33 is various types of devices mounted on the train. The display information generating unit 34 generates the display information based on the information obtained from the device group 33 through the onboard information transmitting unit 36. Although not illustrated in FIG. 1, the onboard device 30 includes a communication device and may perform communication such as Internet Protocol (IP) communication with the ground device 50 and the operation status reproducing device 10.

Returning to the description of the operation status reproducing device 10, the specific event detecting unit 12 analyzes the onboard information obtained by the onboard information obtaining unit 11 and determines whether information when the specific event occurs is included in the onboard information. The specific event corresponds to occurrence of train delay, occurrence of car malfunction and the like, but the specific event is not limited thereto. When the specific event detecting unit 12 determines that the information when the specific event occurs is included in the obtained onboard information, the specific event detecting unit 12 instructs the ground information obtaining unit 13 to obtain the ground information in a period including specific event occurrence time being time at which the specific event occurs and instructs the external information obtaining unit 14 to obtain the external information for this period. The ground information and the external information are to be described later. The specific event detecting unit 12 also extracts the onboard information of the period including the specific event occurrence time out of the onboard information obtained by the onboard information obtaining unit 11 and outputs the same to the display information reproducing unit 15 and the device operating information reproducing unit 16. When there is a plurality of pieces of information when the specific event occurs in the onboard information obtained by the onboard information obtaining unit 11, the specific event detecting unit 12 instructs the ground information obtaining unit 13 to obtain the ground information of the period including the specific event occurrence time and instructs the external information obtaining unit 14 to obtain the external information for each specific event occurrence time. Similarly, when there is a plurality of pieces of information when the specific event occurs in the onboard information obtained by the onboard information obtaining unit 11, the specific event detecting unit 12 extracts the onboard information of the period including the specific event occurrence time and outputs the same to the display information reproducing unit 15 and the device operating information reproducing unit 16 for each specific event occurrence time.

The ground information obtaining unit 13 obtains the ground information from a database 51 of the ground device 50 to output to the ground information reproducing unit 17. The ground information obtained by the ground information obtaining unit 13 is information regarding the train on which the onboard device 30 from which the onboard information obtaining unit 11 obtains the onboard information is mounted, that is, the train designated by the user out of the information managed by the database 51. Information such as position information, operation information, a train number and the like of the train is managed by the database 51, and the ground information obtaining unit 13 obtains the position information, the operation information and the like of the train as the ground information. The operation information to be obtained includes various pieces of information regarding the operation of the train designated by the user such as a type of the train designated by the user, a destination, a stopping station, estimated arrival time to each station, actual arrival time to each station, estimated departure time from each station, and actual departure time from each station. The ground information obtaining unit 13 obtains the ground information of a period designated by the specific event detecting unit 12. The ground information obtained by the ground information obtaining unit 13 includes time information. Herein, the time information is the information of the date and time at which the ground information is recorded by the ground device 50, that is, the date and time at which the ground information is recorded in the database 51.

The external information obtaining unit 14 obtains information such as weather information and topical information from the database 70 as the external information and outputs the same to the external display information generating unit 18. The external information obtaining unit 14 obtains the external information of the period designated by the specific event detecting unit 12. The external information obtaining unit 14 also outputs time information indicating time of contents indicated by the external information, that is, the time information indicating the period designated by the specific event detecting unit 12 when outputting the external information.

The display information reproducing unit 15 generates an image or character information for reproducing the contents of the onboard information received from the specific event detecting unit 12 on the display device 22. The image and the character information generated by the display information reproducing unit 15 are display information indicating contents similar to those of the image and the character displayed on the display device installed in the operator's room of the train, that is, the display device 35 of the onboard device 30. The display information reproducing unit 15 associates the generated display information with time information to output to the timing control unit 19. The time information is herein information of time at which the contents similar to the contents indicated by the generated display information are displayed on the display device 35 of the onboard device 30, that is, the time information included in the onboard information used for generating the display information.

The device operating information reproducing unit 16 generates information for reproducing contents of operation executed on the device mounted on the train, that is, the various devices included in the device group 33 of the onboard device 30 by the display device 22 or the audio output device 23 based on the onboard information received from the specific event detecting unit 12. The information generated by the device operating information reproducing unit 16 is an image, character information, or audio information. The image and the character information are operating information indicating the contents of the operation of a main controller, a brake, a door opening/closing device and the like. The audio information is information of audio output to the operator when the train is operated. The device operating information reproducing unit 16 associates the generated operating information and audio information with the time information included in the onboard information used when generating the operating information and the audio information to output to the timing control unit 19. A process of the device operating information reproducing unit 16 to generate the audio information corresponds to a process executed as an audio reproducing unit.

The ground information reproducing unit 17 generates an image or character information for allowing the display device 22 to display the contents of the ground information received from the ground information obtaining unit 13. The information generated by the ground information reproducing unit 17 is operation status reproduction information indicating the operation status of the train such as a travel position of the train, occurrence of delay and the like. The ground information reproducing unit 17 associates the generated information with the time information received from the ground information obtaining unit 13 together with the ground information used for generating the information to output to the timing control unit 19. Meanwhile, the ground information reproducing unit 17 may generate the audio information indicating the contents of the ground information received from the ground information obtaining unit 13. That is, the ground information reproducing unit 17 may generate the audio information in place of the character information, for example.

The external display information generating unit 18 generates an image or character information for allowing the display device 22 to display contents of the external information received from the external information obtaining unit 14 as external display information. The external display information generating unit 18 associates the generated external display information with the time information received together with the external information to output to the timing control unit 19. Meanwhile, the external display information generating unit 18 may generate audio information indicating the contents of the external information received from the external information obtaining unit 14.

The timing control unit 19 adjusts output timing of the image, the character information, and the audio information received from the display information reproducing unit 15, the device operating information reproducing unit 16, the ground information reproducing unit 17, and the external display information generating unit 18 such that the pieces of information with the same time information received are input to the display information synthesizing unit 20 or the audio generating unit 21 at the same timing. The timing control unit 19 outputs the image and the character information to the display information synthesizing unit 20 and outputs the audio information to the audio generating unit 21. The timing control unit 19 also registers the image, the character information, the audio information, and the time information received from the display information reproducing unit 15, the device operating information reproducing unit 16, the ground information reproducing unit 17, and the external display information generating unit 18 to the database 25 as reproduction information.

The display information synthesizing unit 20 synthesizes the image and the character information received from the timing control unit 19 to generate a display image displayed on the display device 22 and outputs the same to the display device 22. The display information synthesizing unit 20 also generates the display image by synthesizing the image and the character information when the image and the character information are input from the reproduction control unit 24 to be described later. The display image generated by the display information synthesizing unit 20 is the reproduction image illustrating the operation status of the train.

The audio generating unit 21 generates audio to be output from the audio output device 23 based on the audio information received from the timing control unit 19 and outputs the same to the audio output device 23. The audio generating unit 21 also generates the audio when the audio information is input from the reproduction control unit 24 to be described later. The audio generated by the audio output device 23 is reproduction audio indicating the operation status of the train.

The display device 22 displays the reproduction image illustrating the operation status of the train generated by the display information synthesizing unit 20.

The audio output device 23 is a speaker and the like and outputs the audio generated by the audio generating unit 21.

The reproduction control unit 24 reads out the reproduction information designated by the user through the input accepting unit 26 from the database 25 and outputs the same to the display information synthesizing unit 20 and the audio generating unit 21.

The database 25 being a storage unit that holds the reproduction information manages the reproduction information received from the timing control unit 19 and outputs the reproduction information requested by the reproduction control unit 24 to the reproduction control unit 24.

The input accepting unit 26 formed of an input device represented by a mouse and a keyboard accepts various pieces of operation from the user and generates information indicating accepted contents to output to each unit of the operation status reproducing device 10.

Figure 2:
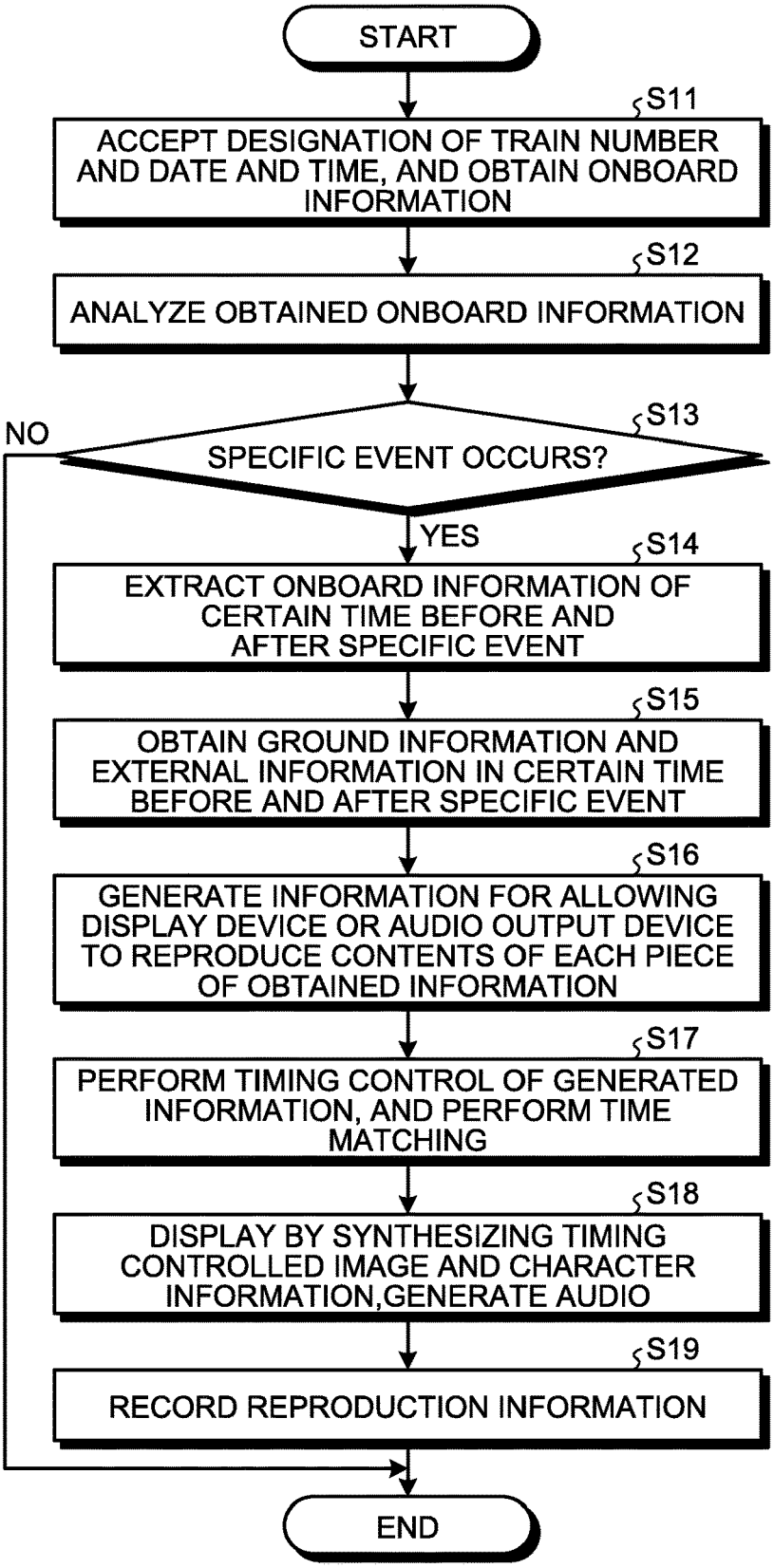
FIG. 2 is a flowchart illustrating an operation example of the operation status reproducing device according to the first embodiment.

Next, entire operation of the operation status reproducing device 10 is described with reference to FIG. 2. FIG. 2 is a flowchart illustrating an operation example of the operation status reproducing device 10.

The operation status reproducing device 10 first externally accepts designation of the train number of the train in which the operation status is to be reproduced and the date and time in which the operation status is to be reproduced and obtains the onboard information recorded at the designated date and time, that is, the period from the onboard device 30 of the designated train (step S11). At this step S11, the operation status reproducing device 10 displays an information input screen 40 illustrated in FIG. 3 on the display device 22 and stands by for an input from the user of required information, that is, the information of the train number and the date and time.

The operation status reproducing device 10 obtains the onboard information when a reproduction start button 44 is selected by click operation and the like after a train number 41, date 42, and time 43 are input through the input accepting unit 26. That is, the operation status reproducing device 10 obtains the onboard information corresponding to the designated date from the onboard information held by the onboard device of the train specified by the train number and the date externally designated through the input accepting unit 26. Specifically, the onboard information obtaining unit 11 generates a request signal including information of the train number, the date, and the time designated by the information input to the information input screen 40 and transmits the request signal to the onboard device 30 mounted on the train of the designated train number through a communication device not illustrated. As an example, the onboard information obtaining unit 11 generates a packet including the information of the date and time designated by the user, sets an address of the onboard device 30 mounted on the train of the train number designated by the user as a destination, and transmits the packet to the address. The operation status reproducing device 10 holds a table indicating a correspondence relationship between an IP address assigned to the onboard device 30 mounted on each train in which the operation status is to be reproduced and the train number. The correspondence relation between the IP address assigned to the onboard device 30 mounted on each train and the train number may be grasped from information managed by the ground device 50, and the operation status reproducing device 10 obtains the information of the correspondence relationship between the IP address assigned to each onboard device 30 and the train number from the ground device 50 in advance. The ground device 50 manages an operation history of each train of the railway system and the information of the IP address assigned to the onboard device 30 mounted on each train. The operation history of the train is the information including information indicating when and with which train number each train is operated, and it is possible to know the IP address assigned to the onboard device 30 mounted on the train corresponding to a certain train number and certain date and time by checking the operation history of the train against the information of the IP address assigned to the onboard device 30 mounted on each train.

Meanwhile, it is not required that the operation status reproducing device 10 hold the table indicating the correspondence relationship between the IP address assigned to the onboard device 30 mounted on each train the operation status of which is to be reproduced and the train number. In this case, when the train number and the date and time are designated at step S11, the operation status reproducing device 10 notifies the ground device 50 of the designated train number and date and time and makes an inquiry about the IP address assigned to the onboard device 30 of the train specified by the notified train number and date and time. Then, the operation status reproducing device 10 generates the above-described packet addressed to the IP address notified from the ground device 50 and transmits the same to the onboard device 30.

When the onboard device 30 receives the packet including the information of the date and time, the onboard device 30 transmits the onboard information corresponding to the received information of the date and time to the operation status reproducing device 10.

When the onboard information obtaining unit 11 of the operation status reproducing device 10 receives the onboard information transmitted from the onboard device 30 through a communication device not illustrated, the onboard information obtaining unit 11 outputs the received onboard information to the specific event detecting unit 12.

The operation status reproducing device 10 next analyzes the onboard information obtained at step S11 (step S12) and checks whether the specific event occurs (step S13). The specific event corresponds to occurrence of train delay, occurrence of car malfunction, performance of specific operation by the operator and the like. The event corresponding to the specific event is determined in advance. At step S12, the specific event detecting unit 12 analyzes the onboard information to detect the occurrence of the specific event.

When the onboard information obtained at step S11 does not indicate the occurrence of the specific event, that is, when the onboard information recorded in a situation in which the specific event occur is not included in the onboard information obtained at step S11 (step S13: No), the operation status reproducing device 10 terminates the process. On the other hand, when the onboard information obtained at step S11 indicates the occurrence of the specific event, that is, when the onboard information recorded in the situation in which the specific event occurs is included in the onboard information obtained at step S11 (step S13: Yes), the operation status reproducing device 10 extracts the onboard information included in a period a certain time before and after occurrence time of the specific event detected at step S13 from the onboard information obtained at step S11 (step S14). The process at step S14 is performed by the specific event detecting unit 12. At step S14, the specific event detecting unit 12 extracts the onboard information included in the period a certain time before and after the occurrence time of the specific event detected at step S13 from the onboard information received from the onboard information obtaining unit 11. The specific event detecting unit 12 outputs the extracted onboard information to the display information reproducing unit 15 and the device operating information reproducing unit 16.

An example of the operation corresponding to steps S11 to S14 heretofore described is herein described. The operation when "A1234" and "Sep. 1, 2016, from 7:00 to 8:00" are designated as the train number and the date and time, respectively, at step S11, and the specific event occurs on Sep. 1, 2016 at 7:24 in the train with the train number of A1234 is described. In this case, the onboard information obtaining unit 11 obtains the onboard information recorded on Sep. 1, 2016 from 7:00 to 8:00 from the onboard device of the train operated with the train number of A1234 on Sep. 1, 2016, and outputs the same to the specific event detecting unit 12 (step S11). The specific event detecting unit 12 analyzes the onboard information received from the onboard information obtaining unit 11 (step S12) and detects that the specific event occurs on Sep. 1, 2016 at 7:24 (step S13: Yes). Then, the specific event detecting unit 12 extracts the onboard information in a certain time before and after the time (7:24) at which the specific event occurs (7:24), herein, the onboard information from 7:19 to 7:29 from the onboard information received from the onboard information obtaining unit 11 (step S14) and outputs the same to the display information reproducing unit 15 and the device operating information reproducing unit 16. Meanwhile, although an example of a case in which the specific event detecting unit 12 extracts the onboard information for five minutes before and after the time at which the specific event occurs is herein illustrated, the example is not limited thereto. It is also possible to extract the onboard information for a period three minutes before and after the time at which the specific event occurs or a period from one minute before the time at which the specific event occurs to five minutes after that. That is, when the specific event detecting unit 12 detects the occurrence of the specific event, the specific event detecting unit 12 extracts the onboard information in a certain period including the occurrence time of the specific event.

Also, the specific event detecting unit 12 might detect the occurrence of a plurality of specific events at step S13. When detecting the occurrence of a plurality of specific events, the specific event detecting unit 12 extracts the onboard information in a certain period including the occurrence time of the specific event for each of the detected specific events. When the specific event detecting unit 12 receives the onboard information on Sep. 1, 2016 from 7:00 to 8:00 from the onboard information obtaining unit 11 and detects that the specific events occurs at 7:15 and 7:50, the specific event detecting unit 12 extracts the onboard information in a certain period including 7:15 and the onboard information in a certain period including 7:50 from the onboard information received from the onboard information obtaining unit 11 and outputs the same to the display information reproducing unit 15 and the device operating information reproducing unit 16.

Returning to the description with reference to FIG. 2, subsequent to step S14, the operation status reproducing device 10 obtains the ground information and the external information in a certain time before and after the occurrence time of the specific event detected at step S13 (step S15). At this step S15, the specific event detecting unit 12 first notifies the ground information obtaining unit 13 of the period of a certain time before and after the occurrence time of the specific event detected at step S13 and the train number designated at step S11. The specific event detecting unit 12 also notifies the external information obtaining unit 14 of the period of a certain time before and after the occurrence time of the specific event detected at step S13. The period of which the specific event detecting unit 12 notifies the ground information obtaining unit 13 and the external information obtaining unit 14 is the same period as the period in which the specific event detecting unit 12 extracts the onboard information at step S14. When the period in which the specific event detecting unit 12 extracts the onboard information at step S14 is "from 7:19 to 7:29", the specific event detecting unit 12 notifies the ground information obtaining unit 13 and the external information obtaining unit 14 of the period of "from 7:19 to 7:29". Next, the ground information obtaining unit 13 obtains the ground information corresponding to the period and the train notified from the specific event detecting unit 12 from the ground device 50. That is, the ground information obtaining unit 13 generates a request signal including the information of the period and the train number notified from the specific event detecting unit 12 and transmits the request signal to the ground device 50 through a communication device not illustrated. The ground information obtaining unit 13 holds the information of the IP address assigned to the ground device 50. Also, the external information obtaining unit 14 obtains the external information corresponding to the period notified from the specific event detecting unit 12 from the database 70. The external information obtaining unit 14 holds information of a Uniform Resource Locator (URL) of the database 70. The external information obtaining unit 14 obtains information of weather, temperature, humidity, a wind speed, a wind direction, rainfall, snowfall and the like of the period notified from the specific event detecting unit 12 when obtaining the weather information as the external information. The external information obtaining unit 14 outputs the obtained external information and time information to the external display information generating unit 18.

The operation status reproducing device 10 next generates information for reproducing the onboard information, the ground information, and the external information obtained from the onboard device 30, the ground device 50, and the database 70, respectively, by the display device 22 or the audio output device 23 (step S16). At this step S16, the display information reproducing unit 15, the device operating information reproducing unit 16, the ground information reproducing unit 17, and the external display information generating unit 18 perform the process. The display information reproducing unit 15 generates the image or the character information for reproducing the contents of the onboard information received from the specific event detecting unit 12 on the display device 22. The device operating information reproducing unit 16 generates the information for reproducing the contents of the operation performed by the operator on the device mounted on the train by the display device 22 or the audio output device 23 based on the onboard information received from the specific event detecting unit 12. The ground information reproducing unit 17 generates the image or the character information for allowing the display device 22 to display the contents of the ground information received from the ground information obtaining unit 13. The external display information generating unit 18 generates the image or the character information for allowing the display device 22 to display the contents of the external information received from the external information obtaining unit 14.

The operation status reproducing device 10 next performs timing control of each piece of information generated at step S16 and performs time matching (step S17). At this step S17, the timing control unit 19 controls the output timing of the pieces of information input from the display information reproducing unit 15, the device operating information reproducing unit 16, the ground information reproducing unit 17, and the external display information generating unit 18 and outputs the pieces of information with which the same time is associated to the display information synthesizing unit 20 or the audio generating unit 21 at the same timing. Out of the information input from the display information reproducing unit 15, the device operating information reproducing unit 16, the ground information reproducing unit 17, and the external display information generating unit 18, the timing control unit 19 outputs the image and the character information to the display information synthesizing unit 20 and outputs the audio information to the audio generating unit 21.

The operation status reproducing device 10 next synthesizes the image and the character information out of the information on which the timing control is performed at step S17 to display and outputs the audio (step S18). At this step S18, the display information synthesizing unit 20 synthesizes each image and each character information input from the timing control unit 19, generates the reproduction image of the operation status of the train designated at step S11, and allows the display device 22 to display the same. Also, the audio generating unit 21 reproduces the audio information input from the timing control unit 19, generates the reproduction audio of the operation status of the train designated at step S11, and outputs the same from the audio output device 23.

Figure 4:
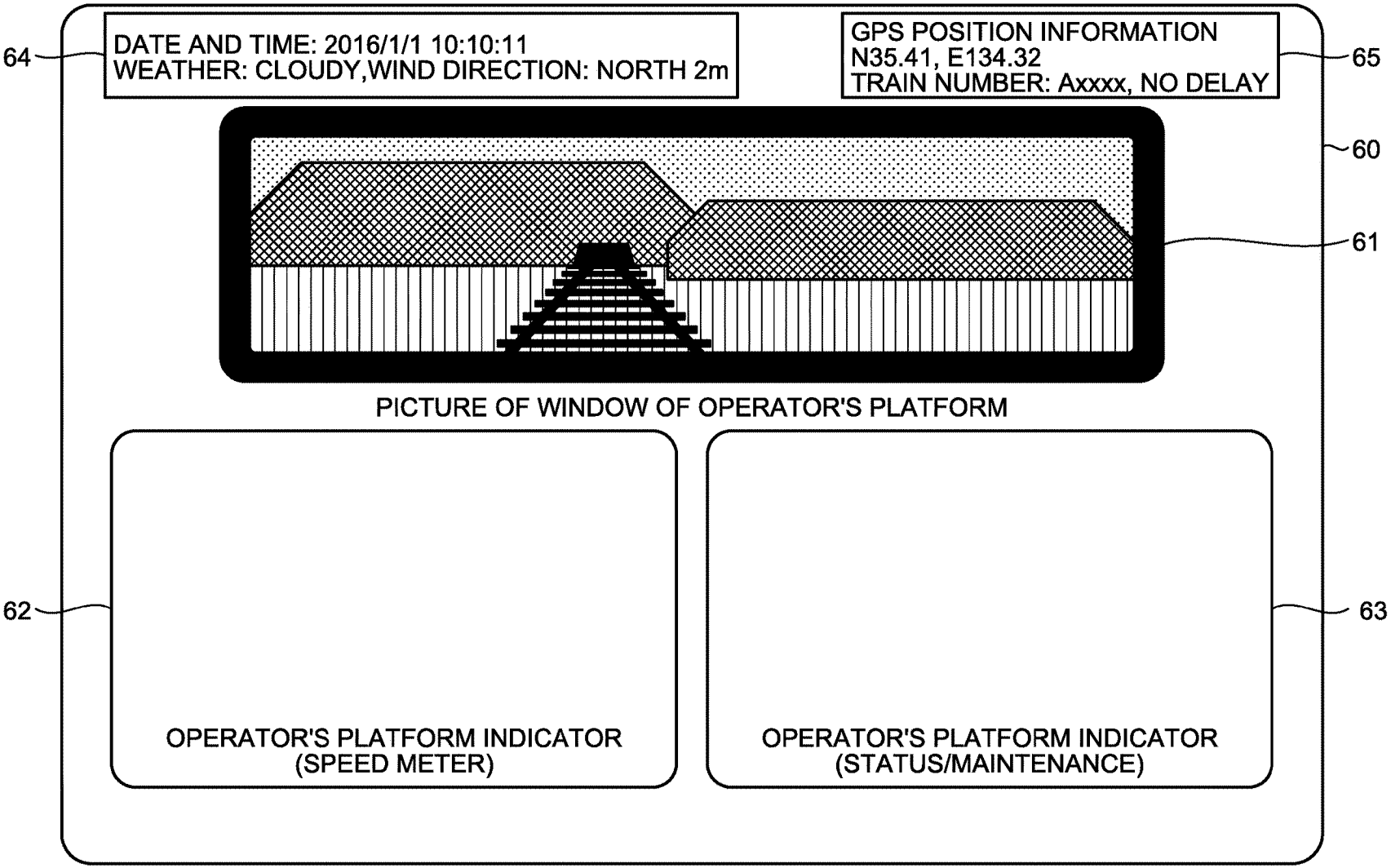
FIG. 4 is a diagram illustrating an example of a reproduction screen displayed on a display device of the operation status reproducing device.
Figure 5:
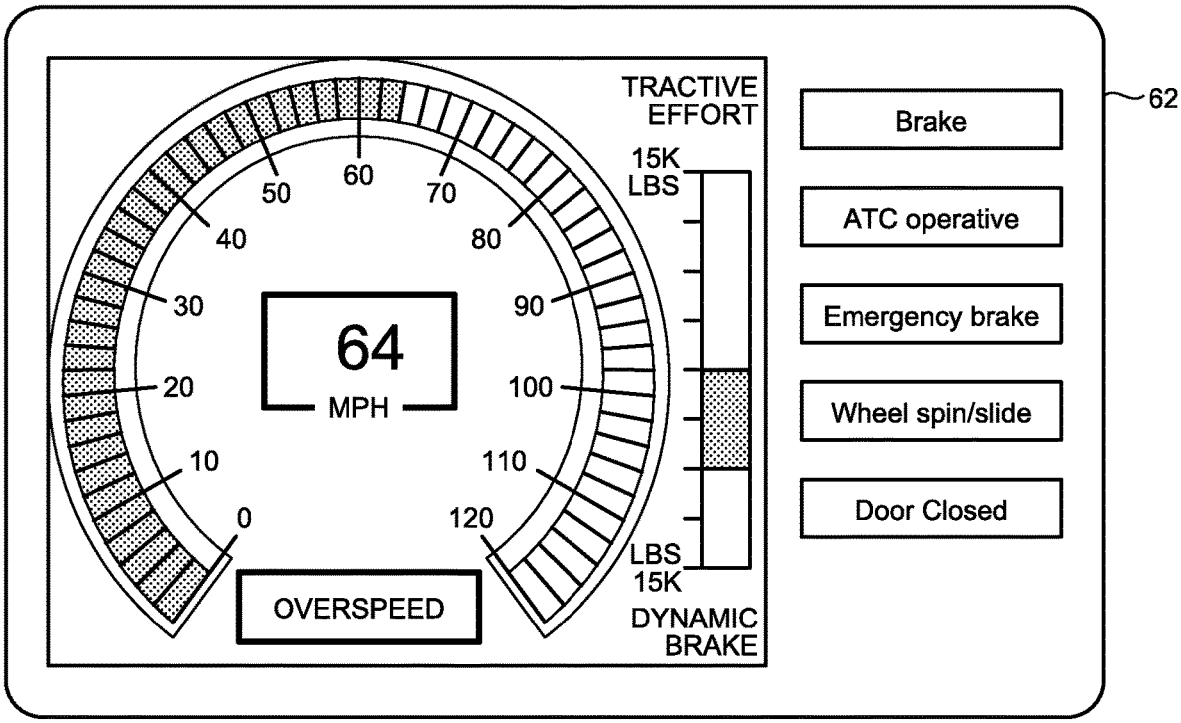
FIG. 5 is a diagram illustrating a display example of a speed meter forming the reproduction screen.
Figure 6:
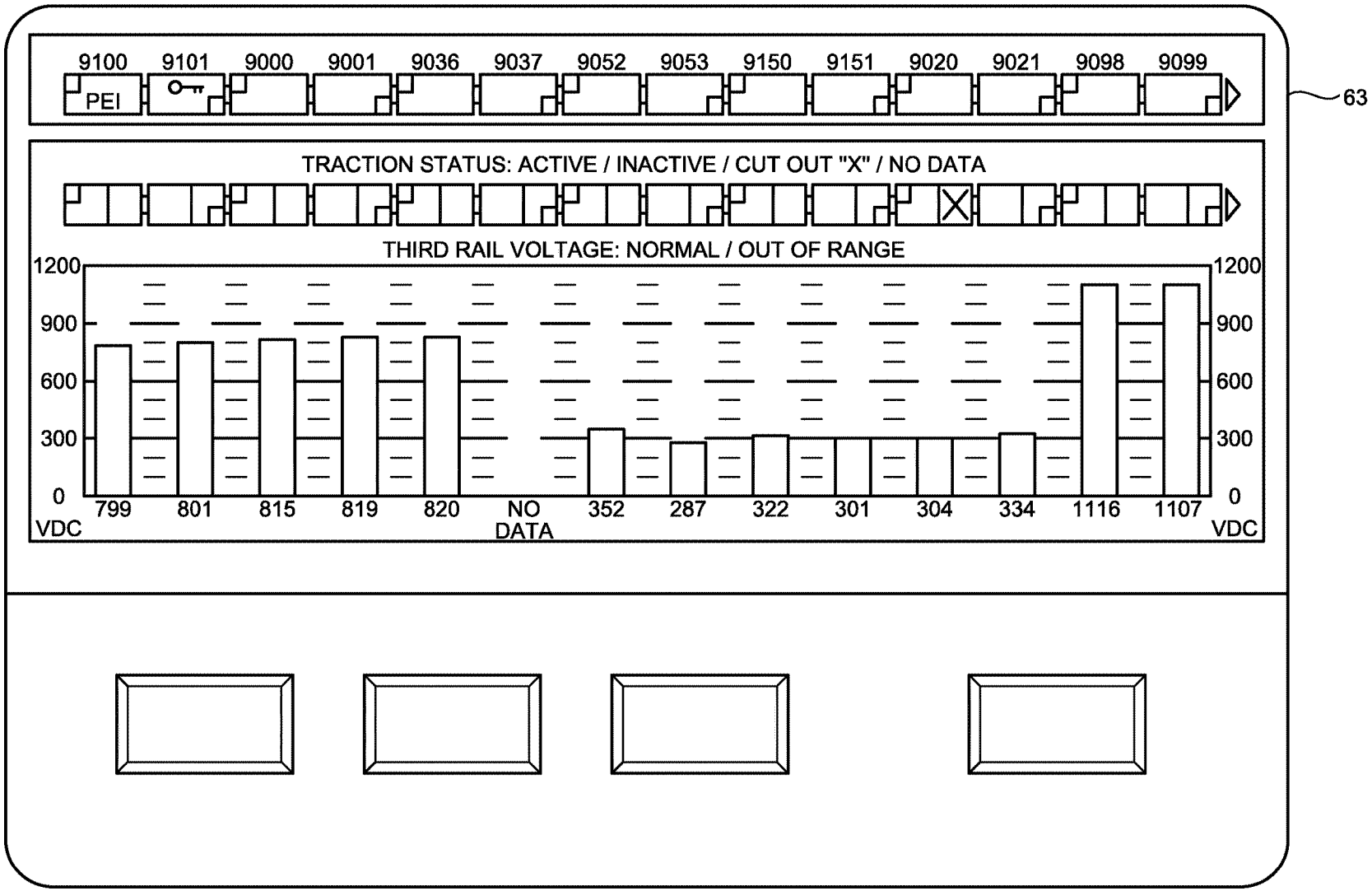
FIG. 6 is a diagram illustrating a display example of a train state forming the reproduction screen.

FIG. 4 is a diagram illustrating an example of a reproduction screen displayed on the display device 22 of the operation status reproducing device 10. As illustrated in FIG. 4, the operation status reproducing device 10 displays a reproduction screen 60 including a picture 61 of a window of an operator's platform, that is, a picture taken by a video camera installed on the operator's platform, displays 62 and 63 reproducing contents displayed on an operator's platform indicator, a display 64 illustrating date and time and weather, and a display 65 illustrating the travel position, the train number, and the operation status of the train on the display device 22. The display 62 is a display of a speed meter of contents as illustrated in FIG. 5 and the display 63 is a display of a train status of contents as illustrated in FIG. 6.

The operation status reproducing device 10 also records the reproduction information (step S19). At this step S19, the timing control unit 19 gathers the pieces of information input from the display information reproducing unit 15, the device operating information reproducing unit 16, the ground information reproducing unit 17, and the external display information generating unit 18 and registers the same as the reproduction information in the database 25. The reproduction information is obtained by gathering each piece of information after the timing control is performed by the timing control unit 19. That is, this is a file generated by gathering each image and each character information output from the timing control unit 19 to the display information synthesizing unit 20 and the audio information output from the timing control unit 19 to the audio generating unit 21. The image, the character information, and the audio information recorded as the reproduction information are synchronized with one another. Meanwhile, order of steps S18 and S19 may be changed or they may be executed in parallel.

Figure 3:
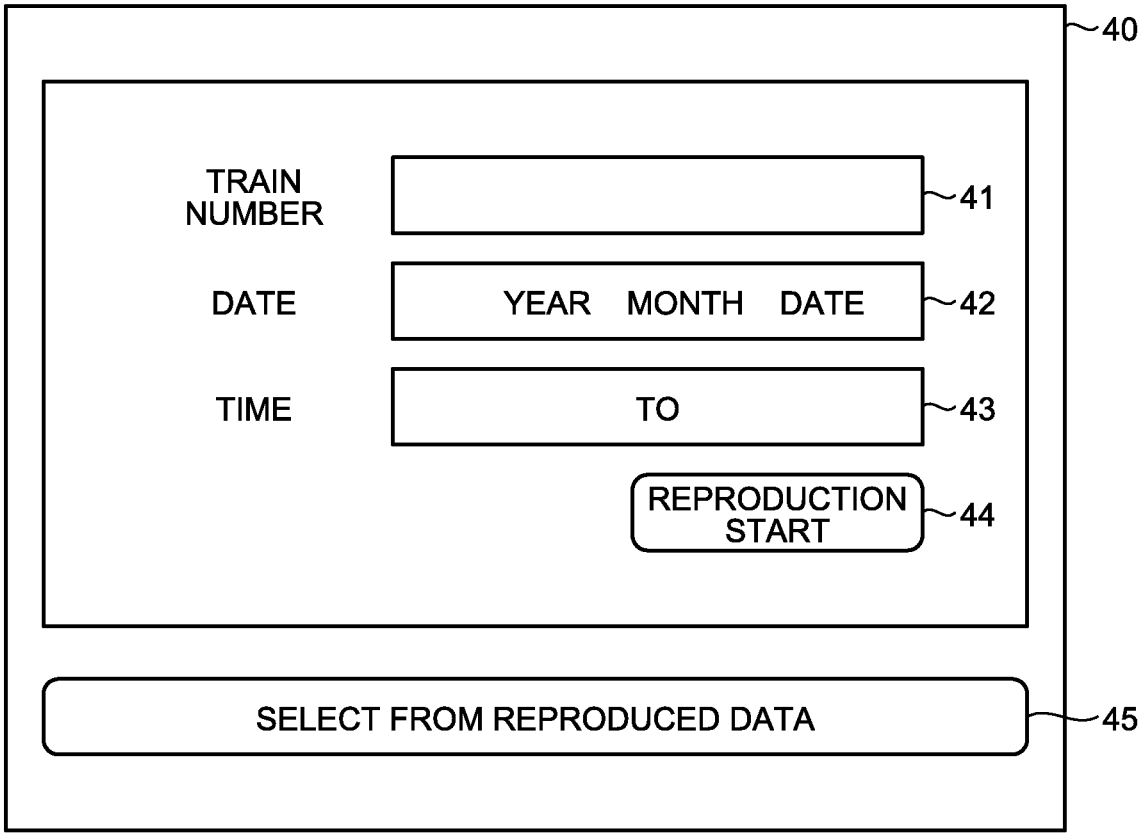
FIG. 3 is a diagram illustrating an example of an information input screen.
Figure 7:
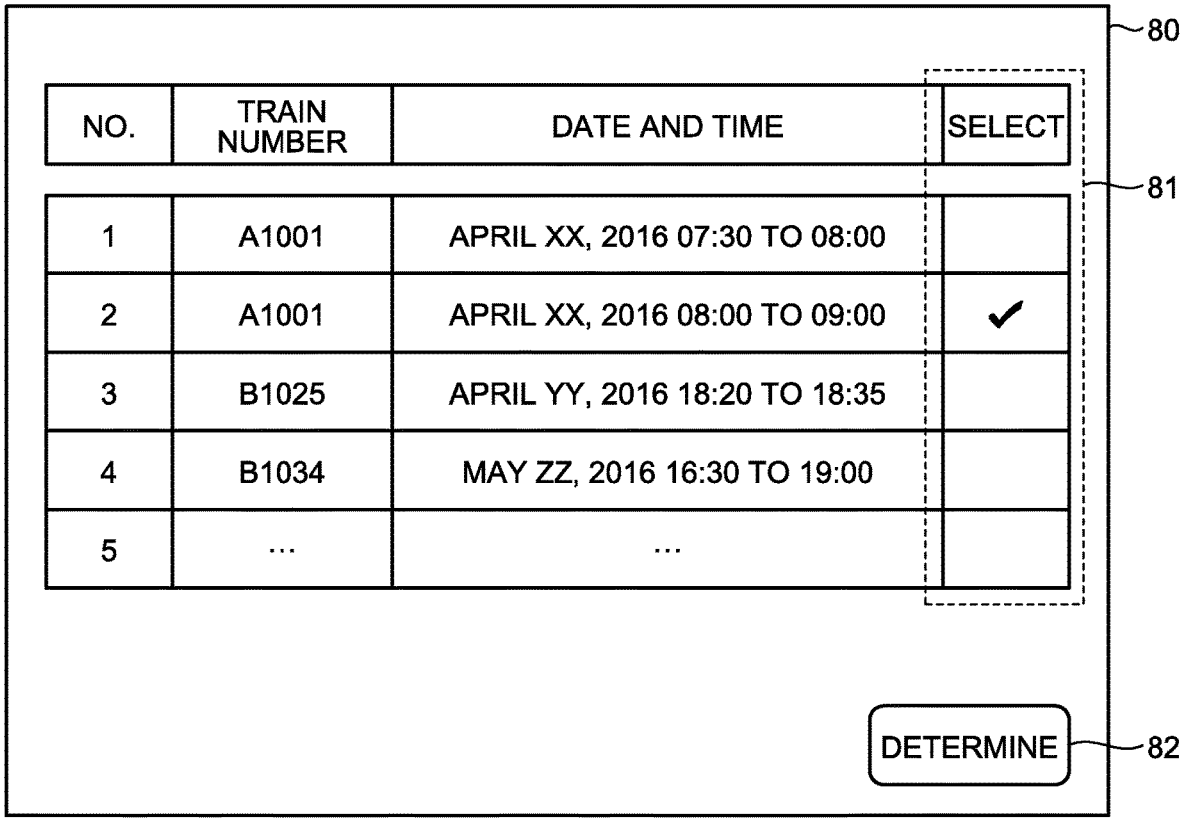
FIG. 7 is a diagram illustrating an example of a selection screen of the reproduction information.

The reproduction information registered in the database 25 is read out by the reproduction control unit 24, the image and the character information are synthesized by the display information synthesizing unit 20 to be output to the display device 22, and the audio information is converted into the audio by the audio generating unit 21 to be output to the audio output device 23. That is, the operation status reproducing device 10 has a function of holding the information used once in reproducing operation as the reproduction information and reproducing the same contents as the contents reproduced in the past by using the held reproduction information. As a result, there is no need of obtaining the onboard information, the ground information, and the external information anew when reproducing again the operation status of the same date and time and the same train, so that a processing load may be reduced and time required for the reproducing operation may be shortened. When a button 45 of "select from reproduced data" is pressed by the user in a state in which the information input screen 40 illustrated in FIG. 3 is displayed on the display device 22, the operation status reproducing device 10 activates the function of reproducing the same contents as the contents reproduced in the past. When the button 45 of "select from reproduced data" is pressed, the operation status reproducing device 10 displays a selection screen 80 illustrated in FIG. 7 on the display device 22. In the selection screen 80 illustrated in FIG. 7, a list of the operation statuses already reproduced in the past is displayed. When a determine button 82 is pressed in a state in which any one of check boxes displayed in an area 81 of the selection screen 80 is checked, the operation status reproducing device 10 reproduces the operation status of the train using the display device 22 and the audio output device based on the reproduction information managed by the database 25. Specifically, when the reproduction control unit 24 receives information indicating that the determine button 82 is pressed from the input accepting unit 26, the reproduction control unit 24 reads out the reproduction information associated with the check box checked when the determine button 82 is pressed from the database 25, outputs the image and the character information included in the read out reproduction information to the display information synthesizing unit 20, and outputs the audio information to the audio generating unit 21.

Meanwhile, the reproduction control unit 24 and the database 25 are components for efficiently reproducing the operation status of the same contents when it is necessary to repeatedly reproduce the operation status of the same contents. Therefore, it is also possible to omit the reproduction control unit 24 and the database 25. Even in a configuration in which the reproduction control unit 24 and the database 25 are omitted, it is possible to repeatedly reproduce the operation status of the same contents by designating the same train number and the same date and time.

Figure 8:
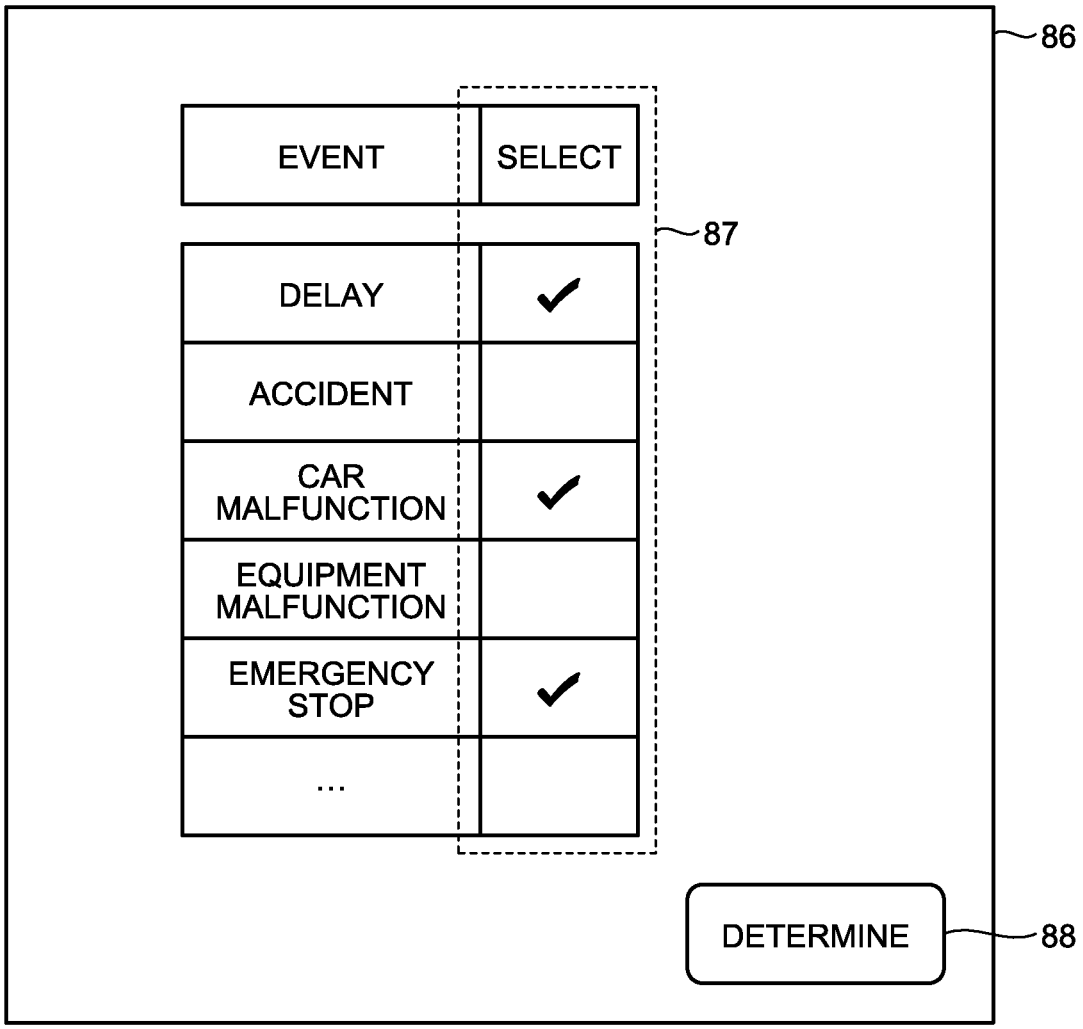
FIG. 8 is a diagram illustrating an example of a selection screen of a specific event.

It is also possible that the specific event in which the specific event detecting unit 12 determines the occurrence by analyzing the onboard information may be selected by the user from a plurality of types of specific events defined in advance. That is, the specific event detecting unit 12 may detect the specific event of the type designated by the user from a plurality of types of specific events. When the user is allowed to select the specific event detected by the specific event detecting unit 12 out of a plurality of types of specific events defined in advance, the operation status reproducing device 10 displays a selection screen of the specific event 86 illustrated in FIG. 8 on the display device 22. The user checks one or more of the check boxes illustrated in an area 87 and presses a determine button 88, thereby designating the type of the specific event detected by the specific event detecting unit 12. When the determine button 88 is pressed in a state in which one or more of the check boxes displayed in the area 87 of the selection screen of the specific event 86 is checked, the operation status reproducing device 10 sets the event associated with the check box checked at the time when the determine button 88 is pressed as the specific event detected by the specific event detecting unit 12. Although delay, accident, car malfunction, equipment malfunction, and emergency stop are exemplified as events which may be set as the specific events detected by the specific event detecting unit 12 in FIG. 8, the events which may be set are not limited to such events.

As described above, upon externally receiving the designation of the train number and the date and time, the operation status reproducing device 10 according to the present embodiment obtains the onboard information of the period indicated by the designated date and time from the onboard device mounted on the train corresponding to the designated train number, checks whether the onboard information at the time when the specific event occurs is included in the obtained onboard information, obtains the ground information and the external information of a certain period including the occurrence time of the specific event when the onboard information when the specific event occurs is included, and reproduces the operation status of the train with the designated train number by the display device 22 and the audio output device 23 by using the obtained ground information and external information and the onboard information of a certain period including the occurrence time of the specific event out of the onboard information obtained from the onboard device. As a result, it is possible to check the operation status before and after the occurrence of the specific event in a short time, and efficiently perform verifying operation of the operation status.

Meanwhile, although the case of the configuration in which the operation status reproducing device 10 includes the display device 22 is described in the present embodiment, the display device 22 may be independent from the operation status reproducing device 10. That is, the display device 22 may be made another device present outside the operation status reproducing device 10. Similarly, the audio output device 23 may be made an external device of the operation status reproducing device 10.

Second Embodiment

The operation status reproducing device 10 described in the first embodiment includes the database 25 that records the reproduction information. However, an amount of information recordable in the database 25 is limited, and when a large amount of reproduction information more than necessary is recordable, this leads to an increase in cost of the device. Therefore, in an operation status reproducing device according to a second embodiment, reproduction information satisfying a certain condition is automatically erased.

Figure 9:
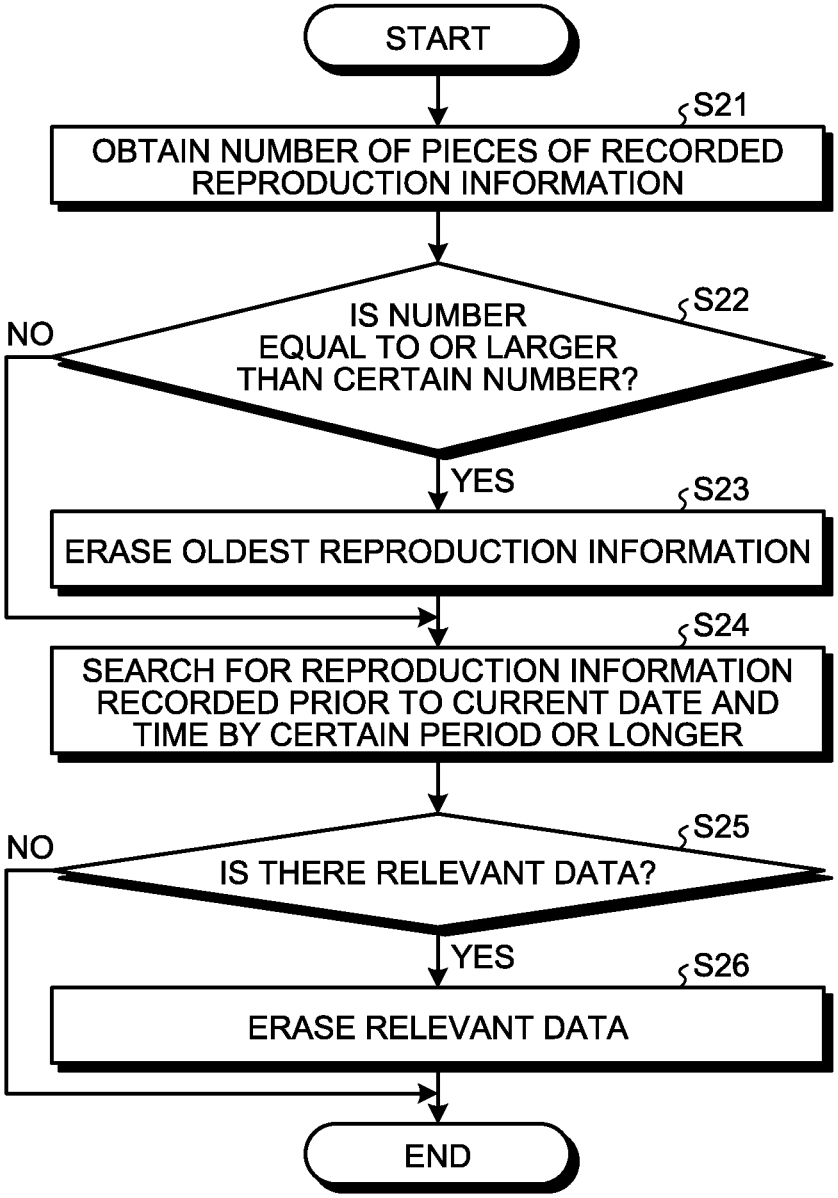
FIG. 9 is a flowchart illustrating an example of operation of managing the reproduction information in the operation status reproducing device according to a second embodiment.

The operation status reproducing device according to the second embodiment is hereinafter described. Meanwhile, a part common to the part of the operation status reproducing device 10 according to the first embodiment is not described. A configuration of the operation status reproducing device according to the second embodiment is similar to the configuration of the operation status reproducing device 10 according to the first embodiment. The operation status reproducing device according to the second embodiment manages the reproduction information according to a flowchart illustrated in FIG. 9. FIG. 9 is the flowchart illustrating an example of operation of managing the reproduction information in the operation status reproducing device according to the second embodiment. The operation status reproducing device according to the second embodiment is common to the operation status reproducing device 10 according to the first embodiment except operation illustrated in FIG. 9.

The operation status reproducing device 10 according to the present embodiment regularly or irregularly executes the operation illustrated in FIG. 9, and erases the reproduction information satisfying a certain condition. The operation status reproducing device 10 executes the operation illustrated in FIG. 9 with a period set in advance such as every day and every week. Alternatively, the operation status reproducing device 10 executes the operation illustrated in FIG. 9 when operation determined in advance is performed. The operation determined in advance may include starting operation, ending operation and the like of the operation status reproducing device 10. Meanwhile, the operation status reproducing device 10 may execute the operation illustrated in FIG. 9 when the operation determined in advance is performed while regularly executing the same.

The operation illustrated in FIG. 9 is described. The operation illustrated in FIG. 9 is operation executed by the reproduction control unit 24. After starting the operation, the reproduction control unit 24 of the operation status reproducing device 10 obtains the number of pieces of reproduction information recorded in the database 25 (step S21). That is, the reproduction control unit 24 accesses the database 25 and obtains the information on the number of pieces of reproduction information recorded in the database 25. Next, the reproduction control unit 24 checks whether the obtained number is equal to or larger than a certain number (step S22). When the obtained number is equal to or larger than the certain number (step S22: Yes), the reproduction control unit 24 erases the oldest reproduction information out of the pieces of reproduction information recorded in the database 25 from the database 25 (step S23) and shifts to step S24. When the number obtained at step S21 is smaller than the certain number (step S22: No), the reproduction control unit 24 shifts to step 24. At step S24, the reproduction control unit 24 accesses the database 25 and searches for the reproduction information recorded prior to current date and time by a certain period or longer (step S24). As a result of the search at step S24, when there is no relevant data, that is, the reproduction information recorded prior to the current date and time by the certain period or longer (step S25: No), the reproduction control unit 24 terminates the process. In contrast, when there is the relevant data (step S25: Yes), the reproduction control unit 24 erases the relevant data, that is, the reproduction information recorded prior to the current date and time by the certain period or longer from the database 25 (step S26).

Meanwhile, although the reproduction control unit 24 performs the process of erasing the old reproduction information based on the number of pieces of reproduction information recorded in the database 25 at steps S21 to S23, it is also possible to erase from the oldest reproduction information in order until a total size becomes smaller than a certain value when the total size of the reproduction information recorded in the database 25 is equal to or larger than the certain value.

In this manner, the operation status reproducing device 10 according to the second embodiment automatically erases a part of the reproduction information when a certain condition is satisfied, so that it is possible to suppress an increase in size of a memory required for realizing the database 25 that records the reproduction information.

Third Embodiment

Figure 10:
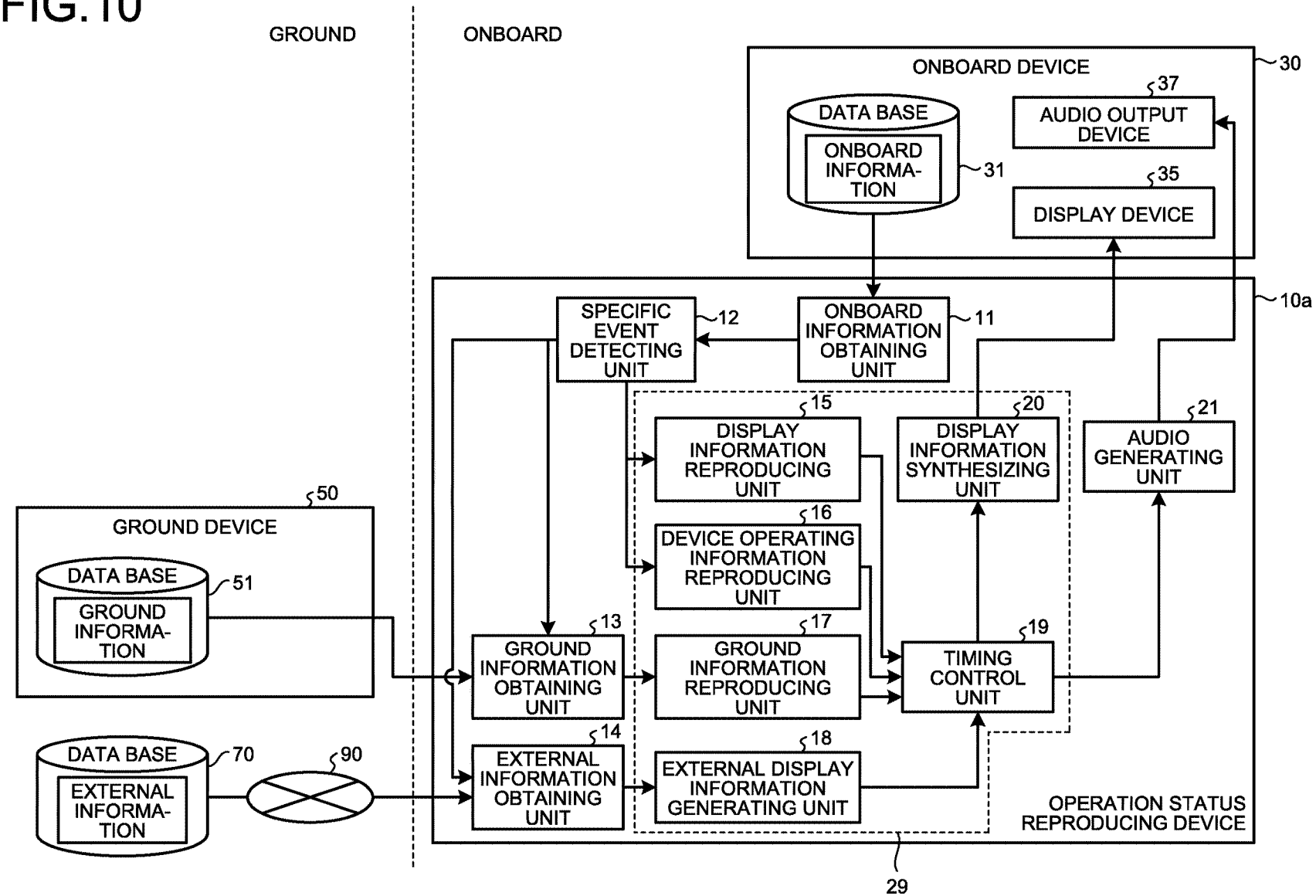
FIG. 10 is a diagram illustrating a configuration example of an operation status reproducing device according to a third embodiment.

FIG. 10 is a diagram illustrating a configuration example of an operation status reproducing device according to a third embodiment. In FIG. 10, components similar to the components of the operation status reproducing device 10 according to the first embodiment (refer to FIG. 1) are assigned with the same reference signs of the operation status reproducing device 10. An operation status reproducing device 10*a* according to the third embodiment is obtained by deleting the display device 22 and the audio output device 23 from the operation status reproducing device 10 according to the first embodiment. Meanwhile, in FIG. 10, the input accepting unit 26, the reproduction control unit 24, and the database 25 are not illustrated.

The operation status reproducing device 10*a* according to the third embodiment is a portable device and is used while being mounted on a train, or is used in a state of always mounted on the train as is the case with an onboard device. Although a basic device configuration of the operation status reproducing device 10*a* is the same as that of the operation status reproducing device 10 according to the first embodiment, the operation status reproducing device 10*a* reproduces the operation status by using external display device and audio output device. Specifically, the operation status reproducing device 10*a* reproduces an operation status by using the display device 35 and an audio output device 37 forming the onboard device 30. The operation status reproducing device 10*a* obtains ground information and external information by wireless transmission.

In this manner, the operation status reproducing device 10*a* according to the third embodiment reproduces the operation status by using the display device 35 and the audio output device 37 forming the onboard device 30. As a result, the device may be made compact and may be made portable. Also, in a case of a train mounted device, it is possible to effectively utilize existing display device and audio output device, thereby realizing reduction in cost and a small size.

Figure 11:
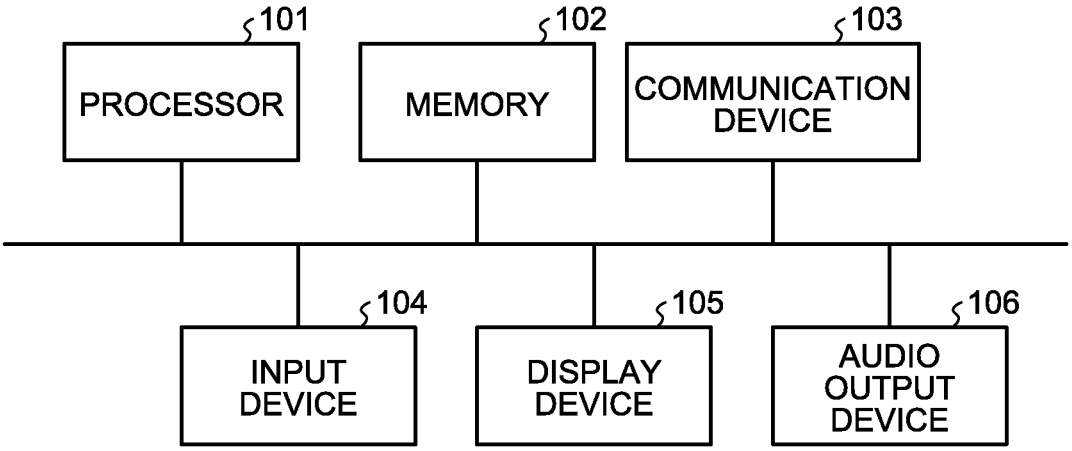
FIG. 11 is a diagram illustrating an example of a hardware configuration for realizing the operation status reproducing device.

Next, a hardware configuration of the operation status reproducing device described in the first to third embodiments is described. FIG. 11 is a diagram illustrating an example of the hardware configuration for realizing the operation status reproducing device. The operation status reproducing device described in the first to third embodiments is realized by a processor 101, a memory 102, a communication device 103, an input device 104, a display device 105, and an audio output device 106.

The processor 101 is a CPU (also referred to as a Central Processing Unit, a central processor, a processing unit, an arithmetic unit, a microprocessor, a microcomputer, a processor, a Digital Signal Processor (DSP) and the like), a system Large Scale Integration (LSI) and the like. The memory 102 is a nonvolatile or volatile semiconductor memory such as Random Access Memory (RAM), a Read Only Memory (ROM), a flash memory, an Erasable Programmable Read Only Memory (EPROM), and an Electrically Erasable Programmable Read Only Memory (EEPROM); a magnetic disc; an optical disc; a compact disc; a mini disc; a Digital Versatile Disc (DVD) and the like.

The communication device 103 includes a modem, a decoder, a wired interface, a wireless interface or the like, and performs wired communication or wireless communication. The input device 104 is a keyboard, a mouse, a touch panel or the like. The display device 105 is a liquid crystal panel or the like, and the audio output device 106 is a speaker or the like.

The onboard information obtaining unit 11, the specific event detecting unit 12, the ground information obtaining unit 13, the external information obtaining unit 14, the display information reproducing unit 15, the device operating information reproducing unit 16, the ground information reproducing unit 17, the external display information generating unit 18, the timing control unit 19, the display information synthesizing unit 20, and the audio generating unit 21 of the operation status reproducing devices 10 and 10*a* illustrated in FIGS. 1 and 10 are realized by the processor 101 and the memory 102 illustrated in FIG. 11. That is, a program for the processor 101 to operate as each of the onboard information obtaining unit 11, the specific event detecting unit 12, the ground information obtaining unit 13, the external information obtaining unit 14, the display information reproducing unit 15, the device operating information reproducing unit 16, the ground information reproducing unit 17, the external display information generating unit 18, the timing control unit 19, the display information synthesizing unit 20, and the audio generating unit 21 is stored in the memory 102, and the processor 101 reads out the program stored in the memory 102 to execute, so that the above-described each unit is realized. The display device 22 illustrated in FIG. 1 corresponds to the display device 105 illustrated in FIG. 11. The audio output device 23 illustrated in FIG. 1 corresponds to the audio output device 106 illustrated in FIG. 11. The input accepting unit 26 illustrated in FIG. 1 is realized by the input device 104 illustrated in FIG. 11. The reproduction control unit 24 and the database 25 illustrated in FIG. 1 are realized by the processor 101 and the memory 102 illustrated in FIG. 11. That is, since the program for the processor 101 to operate as the reproduction control unit 24 and the database 25 is stored in the memory 102, and the processor 101 reads out the program stored in the memory 102 to execute, the reproduction control unit 24 and the database 25 are realized. The reproduction information managed by the database 25 is written in the memory 102. The communication device 103 is used when the onboard information obtaining unit 11, the ground information obtaining unit 13, and the external information obtaining unit 14 realized by the processor 101 and the memory 102 obtain the onboard information, the ground information, or the external information.

The configuration described in the above-described embodiments illustrates one example of the contents of the present invention and this may be combined with another known technology, and it is possible to omit or change a part thereof without departing from the gist of the present invention.

REFERENCE SIGNS LIST

10, 10*a* operation status reproducing device; 11 onboard information obtaining unit; 12 specific event detecting unit; 13 ground information obtaining unit; 14 external information obtaining unit; 15 display information reproducing unit; 16 device operating information reproducing unit; 17 ground information reproducing unit; 18 external display information generating unit; 19 timing control unit; 20 display information synthesizing unit; 21 audio generating unit; 22, 35, 105 display device; 23, 37, 106 audio output device; 24 reproduction control unit; 25, 31, 51, 70 database; 26 input accepting unit; 29 reproduction image generating unit; 30 onboard device; 32 onboard information recording unit; 33 device group; 34 display information generating unit; 36 onboard information transmitting unit; 40 information input screen; 50 ground device; 80 selection screen; 86 selection screen of specific event; 90 network.

The invention claimed is:

1. An operation status reproducing device to reproduce an operation status of a train based on onboard information managed by an onboard device mounted on each train of a railway system and ground information managed by a ground device to monitor an operation status of each train of the railway system, the operation status reproducing device comprising:

an onboard information obtainer to obtain the onboard information corresponding to a date, a start time, and an end time from the onboard device mounted on a designated train being a train specified by a train number and the date, the start time, and the end time externally designated, wherein the date, the start time, and the end time define an externally-designated time period for the train;

a specific event detector to specify time at which a specific event occurs by analyzing the onboard information obtained by the onboard information obtainer;

a ground information obtainer to obtain the ground information in a certain period including the time at which the specific event detected by the specific event detector occurs from the ground device, wherein the certain period is only a portion of the externally-designated time period;

an external information obtainer to obtain external information including weather information in the certain period including the time at which the specific event detected by the specific event detector occurs; and a reproduction image generator to generate a reproduction image illustrating a past operation status of the designated train based on the onboard information, the ground information, and the external information.

2. The operation status reproducing device according to claim 1, further comprising:

a display device to display the reproduction image generated by the reproduction image generator.

3. The operation status reproducing device according to claim 1, wherein a display device forming the onboard device is allowed to display the reproduction image generated by the reproduction image generator.

4. The operation status reproducing device according to claim 1, wherein the reproduction image generator includes:

a display information reproducer to generate display information for reproducing an image and character information displayed on a display device installed in an operator's room of the designated train based on the onboard information in the certain period;

a device operating information reproducer to generate operating information for reproducing contents of operation executed on a device mounted on the designated train based on the onboard information in the certain period;

a ground information reproducer to generate operation status reproduction information for reproducing an operation status of the designated train based on the ground information in the certain period;

an external display information generator to generate external display information indicating weather in a travel position of the designated train based on the external information in the certain period; and a display information synthesizer to generate the reproduction image by synthesizing the display information, the operating information, the operation status reproduction information, and the external display information.

5. The operation status reproducing device according to claim 4, further comprising:

a memory to hold the display information, the operating information, the operation status reproduction information, and the external display information as reproduction information; and a reproduction controller to read out the reproduction information from the memory and output to the display information synthesizer, and make the display information synthesizer generate the reproduction image based on the output reproduction information.

6. The operation status reproducing device according to claim 5, wherein the reproduction controller executes a process of erasing the oldest reproduction information from the memory when the reproduction information held by the memory exceeds a certain value and a process of erasing the reproduction information recorded prior to current date and time by a certain period or longer out of the reproduction information held by the memory from the memory.

7. The operation status reproducing device according to claim 1, further comprising:

an audio reproducer to generate audio information output when the designated train is operated based on the onboard information in the certain period.

8. A display device that displays the reproduction image generated by the operation status reproducing device according to claim 1.

9. An operation status reproducing method to reproduce an operation status of a train based on onboard information managed by an onboard device mounted on each train of a railway system and ground information managed by a ground device to monitor an operation status of each train of the railway system, the operation status reproducing method comprising:

obtaining the onboard information corresponding to a date, a start time, and an end time from the onboard device mounted on a designated train being a train specified by a train number and the date, the start time, and the end time externally designated, by an onboard information obtainer, wherein the date, the start time, and the end time define an externally-designated time period for the train;

specifying time at which a specific event occurs by analyzing the obtained onboard information, by a specific event detector;

obtaining the ground information in a certain period including time at which the specific event detected by the specific event detector occurs from the ground device, by a ground information obtainer, wherein the certain period is only a portion of the externally-designated time period;

obtaining external information including weather information in the certain period including the time at which the specific event detected by the specific event detector occurs, by an external information obtainer; and generating a reproduction image illustrating a past operation status of the designated train based on the onboard information, the ground information, and the external information, by a reproduction image generator.

10. The operation status reproducing device according to claim 1, wherein the onboard information comprises past operation of the train including an operation state of a device mounted on the train; and wherein the ground information comprises position information of the train.

* * * * *